US009102038B2

(12) United States Patent
Kinoshita

(10) Patent No.: US 9,102,038 B2
(45) Date of Patent: Aug. 11, 2015

(54) BEVELING GRINDSTONE

(75) Inventor: Toshiya Kinoshita, Tokyo (JP)

(73) Assignee: NIPPON STEEL & SUMIKIN MATERIALS CO., LTD., Tokyo (JP)

( * ) Notice: Subject to any disclaimer, the term of this patent is extended or adjusted under 35 U.S.C. 154(b) by 0 days.

(21) Appl. No.: 14/110,978

(22) PCT Filed: Aug. 24, 2011

(86) PCT No.: PCT/JP2011/004694
§ 371 (c)(1),
(2), (4) Date: Nov. 20, 2013

(87) PCT Pub. No.: WO2013/027243
PCT Pub. Date: Feb. 28, 2013

(65) Prior Publication Data

US 2014/0080394 A1 Mar. 20, 2014

(51) Int. Cl.
*B24D 5/02* (2006.01)
*B24D 3/06* (2006.01)
*B24B 9/06* (2006.01)

(52) U.S. Cl.
CPC . *B24D 5/02* (2013.01); *B24B 9/065* (2013.01); *B24D 3/06* (2013.01)

(58) Field of Classification Search
CPC ..... B24D 7/18; B24D 5/123; B24D 5/12; B28D 1/041; B23D 61/18
USPC ..... 451/547, 540, 541
See application file for complete search history.

(56) References Cited

U.S. PATENT DOCUMENTS

| | | | | | |
|---|---|---|---|---|---|
| 424,763 | A | * | 4/1890 | Cunningham | 451/547 |
| 2,277,696 | A | * | 3/1942 | Goddu | 451/541 |
| 3,615,309 | A | * | 10/1971 | Dawson | 51/309 |
| 5,609,514 | A | * | 3/1997 | Yasunaga et al. | 451/65 |
| 5,613,894 | A | * | 3/1997 | Delle Vedove | 451/1 |
| 6,093,087 | A | * | 7/2000 | Hakomori et al. | 451/57 |

(Continued)

FOREIGN PATENT DOCUMENTS

| | | |
|---|---|---|
| JP | 56-032267 | 9/1982 |
| JP | 05-013388 | 1/1993 |

(Continued)

OTHER PUBLICATIONS

International Search Report issued Nov. 8, 2011 in International (PCT) Application No. PCT/JP2011/004694.

(Continued)

*Primary Examiner* — George Nguyen
(74) *Attorney, Agent, or Firm* — Wenderoth, Lind & Ponack, L.L.P.

(57) ABSTRACT

Provided is a beveling grindstone in which diamond abrasive grains etc. are prevented from falling off even after long-term grinding to allow long-term use of the grindstone and in which chipping that occurs during beveling of a hard and brittle material and the occurrence of cracking in the ground material are suppressed. The beveling grindstone is used to bevel the outer circumferential edge of a hard and brittle material and includes: a core having a groove portion formed on the outer circumferential surface thereof with which the outer circumferential edge of the hard and brittle material is brought into contact; and an abrasive grain layer which is formed in the groove portion and to which abrasive grains are secured by brazing. The abrasive grains have an average grain diameter of #4000 to #270.

4 Claims, 7 Drawing Sheets

(56) References Cited

U.S. PATENT DOCUMENTS

| | | | | |
|---|---|---|---|---|
| 6,159,081 | A * | 12/2000 | Hakomori | 451/57 |
| 6,358,133 | B1 * | 3/2002 | Cesena et al. | 451/450 |
| 8,033,893 | B2 * | 10/2011 | Haneda et al. | 451/5 |
| 2004/0198206 | A1 * | 10/2004 | Toge et al. | 451/547 |
| 2009/0275274 | A1 | 11/2009 | Sakamoto et al. | |

FOREIGN PATENT DOCUMENTS

| | | |
|---|---|---|
| JP | 6-262505 | 9/1994 |
| JP | 09-007978 | 1/1997 |
| JP | 2002-273662 | 9/2002 |
| JP | 2003-39328 | 2/2003 |
| JP | 2003-159655 | 6/2003 |
| JP | 2003-170358 | 6/2003 |
| JP | 2005-59194 | 3/2005 |
| JP | 2006-024840 | 1/2006 |
| JP | 2006-263890 | 10/2006 |
| JP | 2007-44817 | 2/2007 |
| JP | 2007-83352 | 4/2007 |
| JP | 2007-237367 | 9/2007 |
| JP | 2008-178957 | 8/2008 |
| JP | 2010-021394 | 1/2010 |
| TW | 200827100 | 7/2008 |
| WO | 2007/034646 | 3/2007 |

OTHER PUBLICATIONS

Notification of Transmittal of Translation of the International Preliminary Report on Patentability mailed Mar. 6, 2014 in corresponding International Application No. PCT/JP2011/004694.

* cited by examiner

FIG.5(a) - Prior Art
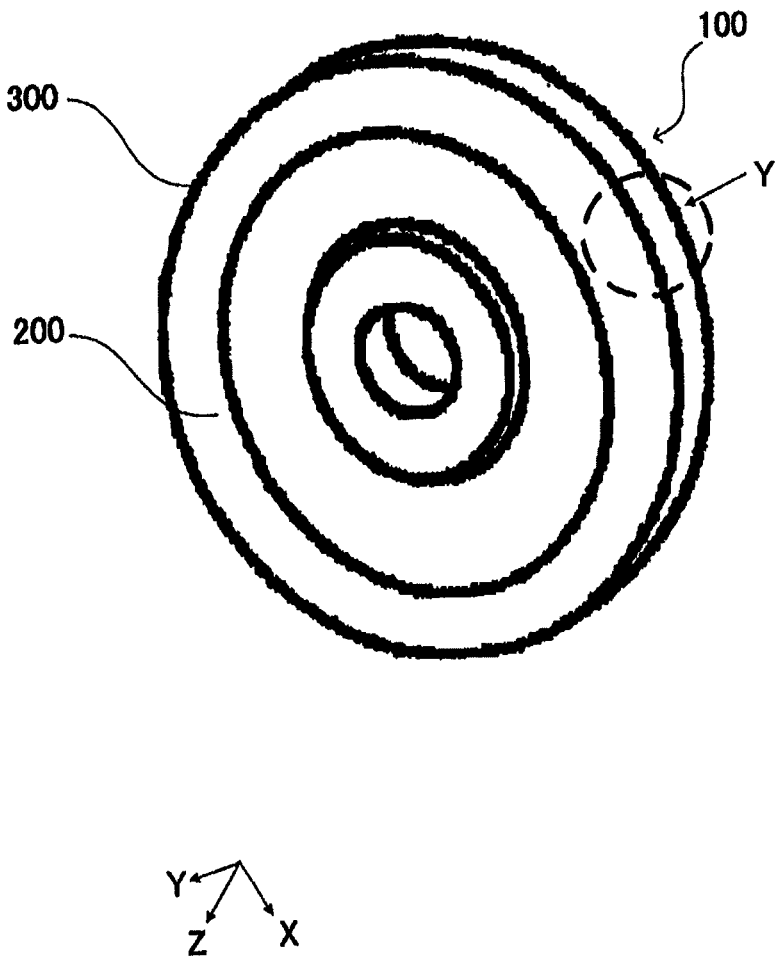

FIG. 5(b) - Prior Art
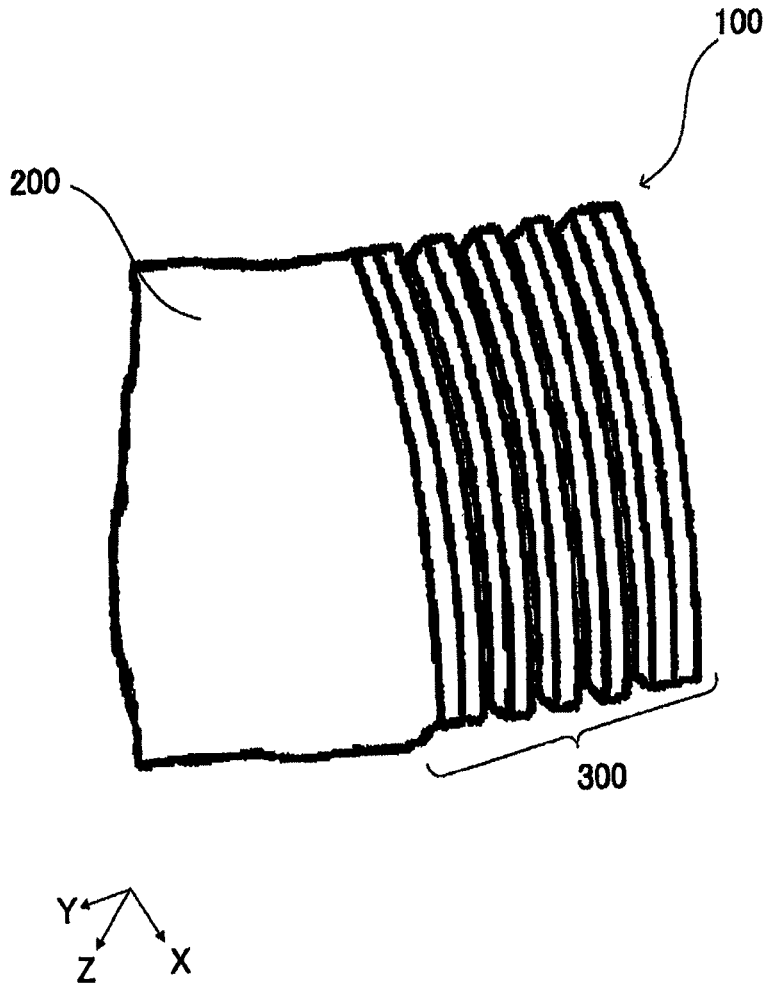

FIG.6 (a) - Prior Art
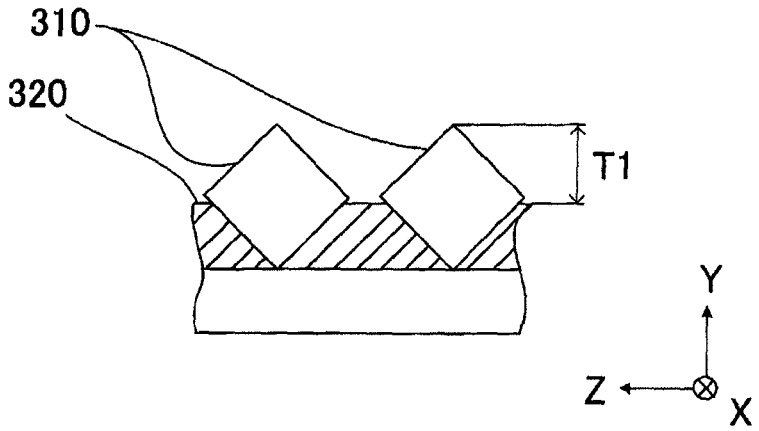
FIG. 6 (b) - Prior Art
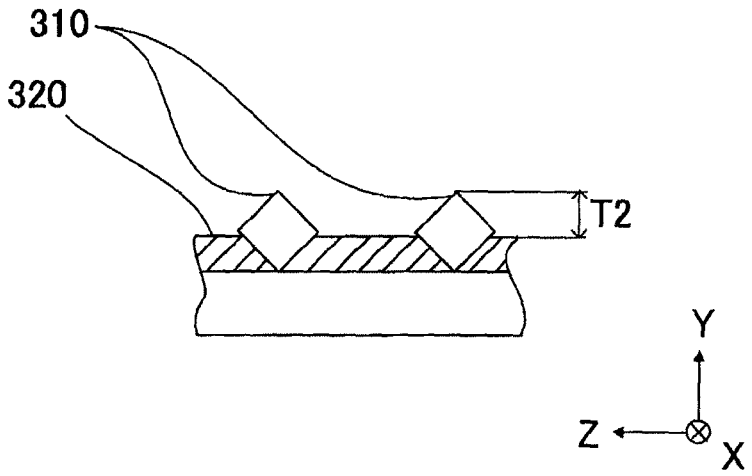

BEVELING GRINDSTONE

TECHNICAL FIELD

The present invention relates to a beveling grindstone for processing the outer circumference of a hard and brittle material.

BACKGROUND ART

One process for producing a wafer such as a silicon wafer or a compound semiconductor wafer includes: a shaping step of shaping a silicon ingot etc. into a cylindrical ingot with predetermined dimensions using an outside diameter blade or a cup-shaped wheel; a slicing step of slicing the cylindrical ingot to a predetermined thickness using an inside diameter blade to form a wafer; a beveling step of beveling the outer circumference of the wafer using a beveling grindstone; and a finishing step of lapping, etching, and polishing the beveled surface of the wafer beveled in the beveling step to complete a substrate of integrated circuits.

FIG. 5(*a*) is a perspective view of a conventional beveling grindstone. FIG. 5(*b*) is a view in the direction of arrow Y in FIG. 5(*a*) and is an enlarged view of groove portions. In the beveling step, a beveling grindstone 100 shown in FIGS. 5(*a*) and 5(*b*) is brought into contact with the radial end face (hereinafter referred to as the outer circumferential surface) of a wafer (not shown) to grind the edge portions of the outer circumferential surface of the wafer. In the cut wafer formed in the shaping step and the slicing step so as to have predetermined dimensions, the edge portions of the outer circumferential surface of the wafer are sharp. When the wafer formed has such sharp edge portions, stress is concentrated on the edge portions of the wafer in the subsequent processing, and chips may fall off the edge portions of the wafer (chipping may occur). When such chipping occurs, the chips falling off the edge portions cause damage to the front and rear surfaces of the wafer in the subsequent processing step (the finishing step), and cracks are thereby formed, so that the yield of the semiconductor production apparatus is reduced. Therefore, it is very important to provide the beveling step of beveling the edge portions of the wafer after the shaping step and the slicing step.

The beveling grindstone 100 used in the beveling step includes a core 200 formed to have a substantially disk shape, as shown in FIG. 5(*a*). As shown in FIG. 5(*b*), a plurality of groove portions are formed on the outer circumferential surface of the core 200, and an abrasive grain layer 300 is secured to these groove portions. The abrasive grain layer 300 is formed over the entire outer circumferential surface of the core 200 and formed by securing an abrasive grain material such as diamond abrasive grains or CBN (cubic boron) abrasive grains (hereinafter referred to as diamond abrasive grains etc.) to the core 200 using a binder.

Known methods for securing diamond abrasive grains etc. to the outer circumferential surface of the core 200 include a resin bonding method, a vitrified bonding method, a metal bonding method (a sintering method), and an electrodeposition method (see Patent Literatures 1 to 6).

One known method for firmly securing diamond abrasive grains to the outer circumferential surface of the core 200 is to secure the diamond abrasive grains by brazing (see Patent Literature 7).

CITATION LIST

Patent Literature

Patent Literature 1: Japanese Patent Application Laid-Open No. 2007-44817

Patent Literature 2: Japanese Patent Application Laid-Open No. 2005-59194

Patent Literature 3: Japanese Patent Application Laid-Open No. 2003-159655

Patent Literature 4: Japanese Patent Application Laid-Open No. 2003-39328

Patent Literature 5: Japanese Patent Application Laid-Open No. 2002-273662

Patent Literature 6: Japanese Patent Application Laid-Open No. Hei. 6-262505

Patent Literature 7: Japanese Patent Application Laid-Open No. 2006-263890

Patent Literature 8: Japanese Patent Application Laid-Open No. 2007-83352

SUMMARY OF INVENTION

Technical Problem

In recent years, there is a demand to reduce the diameter of abrasive grains in order to extend the life of the grindstone, minimize the distortion of the edge shape, and prevent cracking and chipping. When abrasive grains with a small grain diameter are secured by, for example, an electrodeposition method, the following problem occurs during cutting of a hard and brittle material. FIG. 6(*a*) schematically illustrates a state in which abrasive grains with a large grain diameter are secured by the electrodeposition method. FIG. 6(*b*) schematically illustrates a state in which abrasive grains with a small grain diameter are secured by the electrodeposition method.

Referring to these figures, when abrasive grains with a large grain diameter are used, i.e., the abrasive grains 310 shown in FIG. 6(*a*) are used, the distance T1 from the upper edges of the abrasive grains 310 (the edges to be in contact with a wafer) to a reference plane (the upper surface of a bonding layer 320) becomes large. When abrasive grains with a small grain diameter are used, i.e., the abrasive grains 310 shown in FIG. 6(*b*) are used, the distance T2 from the upper edges of the abrasive grains 310 to the reference plane becomes small. Therefore, when the abrasive grains with a large grain diameter are used, a sufficient distance from the edge of a wafer to be ground to the reference plane is ensured, so that erosion of the bonding layer caused by contact of the wafer with the reference plane of the bonding layer 320 during grinding can be suppressed. However, when the abrasive grains with a small grain diameter are used, a sufficient distance from the edge of the wafer to be ground to the reference plane cannot be ensured. Therefore, the edge of the wafer comes into contact with the reference plane during grinding, so that the bonding layer 320 is eroded. With the conventional bonding methods, such as the electrodeposition method, described in Patent Literatures 1 to 6, the securing strength for securing the abrasive grains is inherently insufficient, and the strength is reduced by erosion of the bonding layer 320. Therefore, the conventional bonding methods are not sufficient as means for securing abrasive grains with a reduced diameter.

In the method disclosed in Patent Literature 7 in which diamond abrasive grains etc. are secured to the outer circumferential surface of the core by brazing, since an object to be ground is glass, the average grain diameter of the diamond abrasive grains is set to be large, i.e., #200/230. Therefore, in Patent Literature 7, there is no description and suggestion about problems caused by reducing the diameter of the abrasive grains. When a beveling grindstone 100 using such diamond abrasive grains having a large grain diameter as described above is used to bevel a hard and brittle material such as a wafer, the wafer is excessively ground, so that chipping, cracking, etc. easily occur.

Accordingly, the present invention provides a beveling grindstone in which diamond abrasive grains etc. are prevented from falling off even after long-term grinding to allow long-term use of the grindstone and in which chipping that occurs during beveling of a hard and brittle material and the occurrence of cracking in the ground material are suppressed.

Solution to Problem

To solve the foregoing problem, the beveling grindstone of the present invention for beveling an outer circumferential edge of a hard and brittle material includes: a core having a groove portion formed on an outer circumferential surface thereof with which the outer circumferential edge of the hard and brittle material is brought into contact; and an abrasive grain layer which is formed in the groove portion and to which abrasive grains are secured by brazing, wherein an average grain diameter of the abrasive grains is #4000 to #270.

Advantageous Effects of Invention

The present invention can provide a technique for enabling a beveling grindstone to be used for a long time. This is achieved by firmly securing diamond abrasive grains etc. with a small grain diameter to the outer circumference of the beveling grindstone. With this technique, chipping that occurs during beveling of a hard and brittle material and the occurrence of cracking in the ground material are suppressed.

BRIEF DESCRIPTION OF DRAWINGS

FIG. 3(*b*) is a reference enlarged view of the portion A when a binder having low wettability is used.

FIG. 5(*a*) is a perspective view of a beveling grindstone in a conventional example.

FIG. 5(*b*) is an enlarged view in the direction of arrow Y in FIG. 5(*a*), illustrating a region surrounded by a dotted line.

FIG. 6(*a*) schematically illustrates a state in which abrasive grains with a large grain diameter are secured by an electrodeposition method.

FIG. 6(*b*) schematically illustrates a state in which abrasive grains with a small grain diameter are secured by the electrodeposition method.

DESCRIPTION OF EMBODIMENTS

Embodiments of the present invention will next be described with reference the drawings.

First Embodiment

Figure 1:
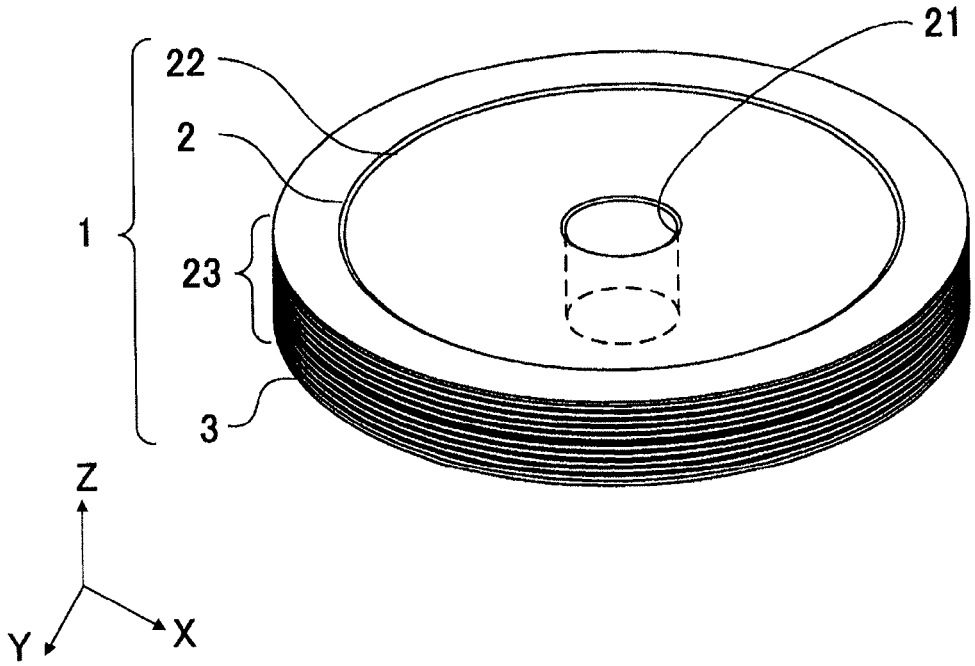
FIG. 1 is a perspective view of a first embodiment of the beveling grindstone according to the present invention.
Figure 2:
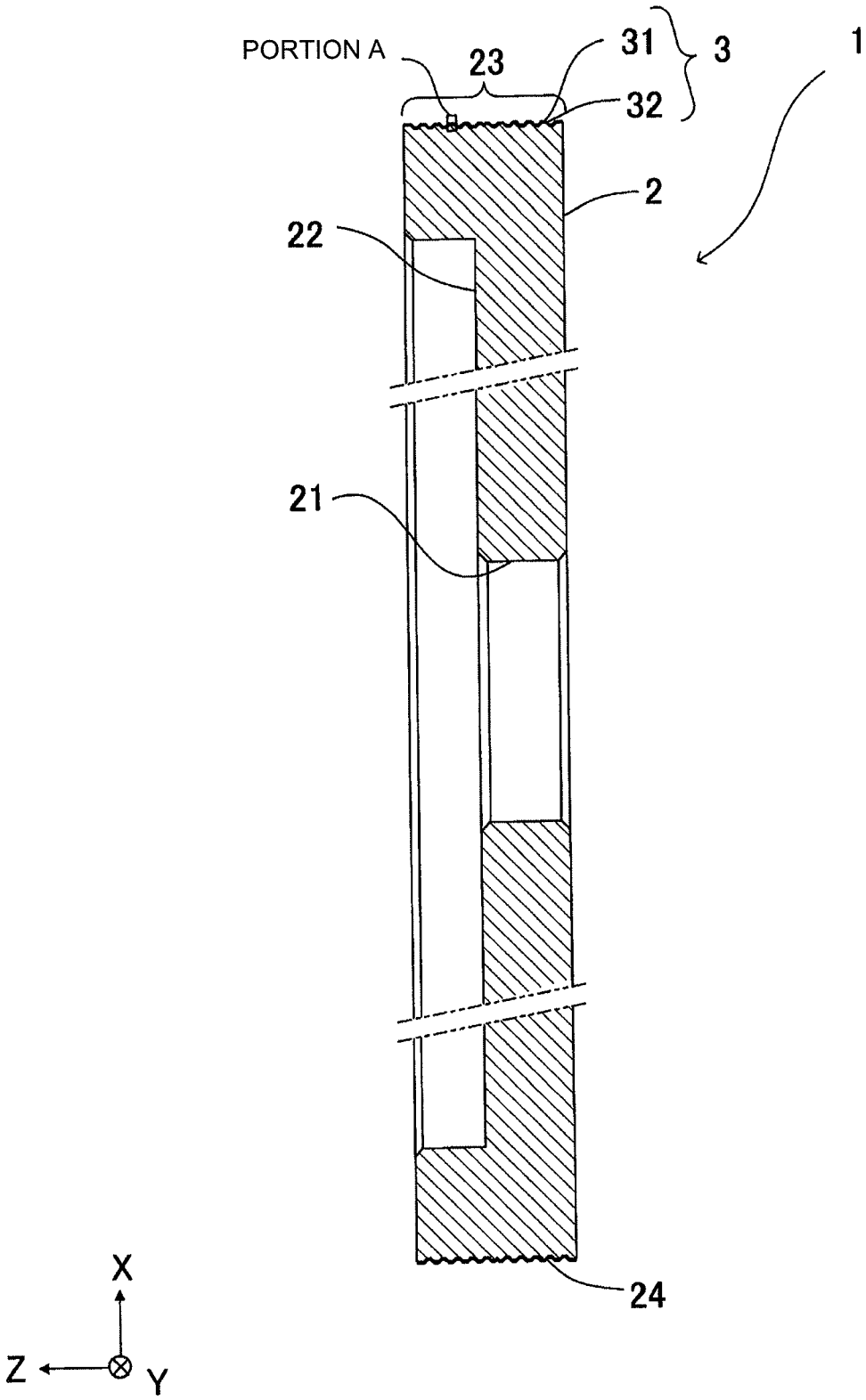
FIG. 2 is an enlarged cross-sectional view of an X-Z cross section in FIG. 1.

FIG. 1 is a perspective view of a beveling grindstone in a first embodiment, and FIG. 2 is a cross-sectional view obtained by cutting the beveling grindstone in FIG. 1 along an X-Z section. Referring to these figures, the beveling grindstone 1 includes a core 2. The core 2 is formed into a substantially disk shape, and a through hole 21 extending in a vertical direction is formed in a radial central portion of the core 2. A rotation shaft 41 of an electric motor 4 described later is inserted into the through hole 21, and the rotation shaft 41 and the core 2 are secured to each other. When the electric motor 4 is driven, the rotation shaft 41 and the core 2 rotate integrally.

The core 2 may be made of stainless steel. Since stainless steel has high wear resistance and high corrosion resistance, the life of the beveling grindstone 1 can be extended. The stainless steel may be SUS304, SUS316, or SUS430.

A groove-ridge portion 23 is formed on the outer circumferential surface of the core 2 located at its radial edge. The groove-ridge portion 23 has a shape formed according to the intended shape of a ground object such as a wafer. For example, when the edges of the outer circumferential surface of a hard and brittle material are beveled at an inclination angle of 45°, an inclined grinding surface portion 24 in the groove-ridge portion 23 is inclined 45° with respect to the radial direction of the core 2. An abrasive grain layer 3 described later is formed on the inclined grinding surface portion 24, and the inclined grinding surface portion 24 is brought into contact with a hard and brittle material, whereby the hard and brittle material can be beveled into the intended shape.

The abrasive grain layer 3 is formed by securing abrasive grains 31 to the groove-ridge portion 23 on the outer circumferential surface of the core 2 by brazing. Since, unlike metal bonds etc., a brazing material 32 has high affinity, the abrasive grains 31 and the brazing material 32 can be secured to each other with no gaps, and the brazing material 32 and the groove-ridge portion 23 can be secured to each other with no gaps. Since the abrasive grains 31 are firmly secured to the groove-ridge portion 23, falling of the abrasive grains 31 can be suppressed.

Figure 3:
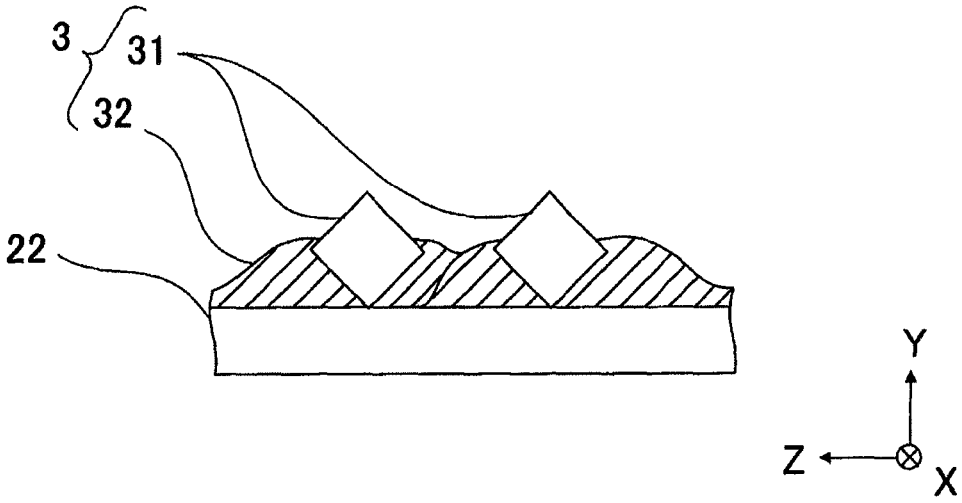
FIG. 3(*a*) is an enlarged view of a portion A in the present invention.
Figure 3:
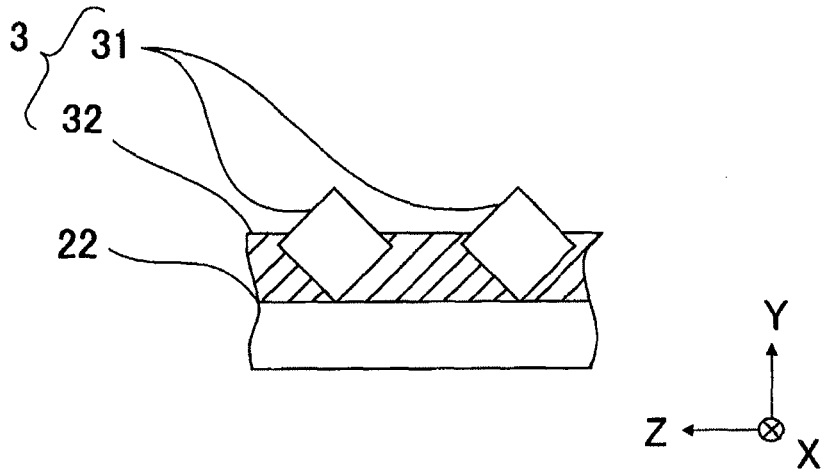

The brazing material 32 can secure the abrasive grains 31 sufficiently strongly through a wetting phenomenon even when the amount of application is small. In addition, in regions in the vicinity of the abrasive grains 31, the thickness of the brazing material is large relative to the thickness of other regions. In regions spaced apart from the abrasive grains 31, the thickness is small relative to the thickness of other regions. Therefore, the brazing material 32 can be disposed at positions spaced apart from a wafer used as a ground object while sufficient securing strength is maintained. In this manner, erosion of the brazing material 32 caused by contact of the wafer during grinding can be suppressed. FIG. 3(*a*) is an enlarged view of an abrasive grain layer 3, schematically illustrating a state in which the brazing material 32 is applied to the groove-ridge portion 23 to secure the abrasive grains 31. FIG. 3(*b*) is an enlarged view of an abrasive grain layer 3, schematically illustrating a state in which the abrasive grains 31 are secured to the groove-ridge portion 23 by an electrodeposition method. Referring to FIG. 3(*a*), when the brazing material 32 is used to secure the abrasive grains 31, the brazing material 32 extends downward along the outer surfaces of the abrasive grains 31, and the thickness of the brazing material 32 decreases as the distance from the abrasive grains 31 increases. Therefore, erosion of the brazing material 32 caused by contact of the wafer used as the ground object can be suppressed. Referring to FIG. 3(*b*), when the abrasive grains 31 are secured to the groove-ridge portion 23 by the electrodeposition method, since the bonding layer is flat, erosion of the brazing material 32 caused by contact of the wafer used as the ground object may proceed. As described above, in this embodiment, attention is given to the wettability of the brazing material 32 to solve the problem caused by reducing the diameter of the abrasive grains 31, i.e., erosion of the bonding layer caused by contact of a wafer used as a ground object. Therefore, the diamond abrasive grains etc. are prevented from falling off even after long-term grinding to thereby achieve long-term use of the grindstone, and chipping that occurs during beveling of a hard and brittle material and the occurrence of cracking in the ground material can be suppressed.

The average grain diameter of the abrasive grains 31 is preferably #4000 (corresponding to 4 μm) to #270 (corresponding to 61 μm) and more preferably #3000 (corresponding to 5 μm) to #270 (corresponding to 61 μm). If the average grain diameter of the abrasive grains 31 is coarser than #270, a hard and brittle material is ground excessively, and cracks occur on the surface of the hard and brittle material. If the average grain diameter of the abrasive grains is finer than #4000, the distance between the brazing material 32 and a wafer used as a grounding object becomes small, and erosion of the brazing material 32 may be facilitated. If the average grain diameter of the abrasive grains is finer than #3000, the amount of protrusion of the abrasive grains 31 becomes small, and the grinding ability becomes low, so that the working efficiency deteriorates.

The average grain diameter is defined as a center diameter represented by D50. The above-described average grain diameter (unit: μm) of the abrasive grains was measured using a Coulter counter "Coulter Multisizer 3" manufactured by. Beckman Coulter, Inc.

Abrasive grains 31 having the grain diameter described above may be arranged in a single layer on the surface of the groove-ridge portion 23. In this case, when abrasive grains 31 with a uniform size are used, the level of the grinding surfaces of the abrasive grains 31 can be maintained uniformly, so that a hard and brittle material is prevented from being ground excessively by some points of the groove-ridge portion 23. More specifically, the hard and brittle material can be beveled without distortion of the shape of the hard and brittle material.

For example, diamond, cubic boron nitride, silicon carbide, and aluminum oxide can be used for the abrasive grains 31.

A brazing material such as a Ni—Cr—Fe—Si—B-based, Ni—Si—B-based, or Ni—Cr—Si—B-based brazing material may be used as the brazing material 32. When P is added to a Ni—Fe—Cr—Si—B-based brazing material, the wettability between the abrasive grains 31 and the brazing material 32 is improved to thereby stabilize adhesion of the abrasive grains 31 to the core 2, so that the abrasive grains 31 can be effectively prevented from falling off the core 2. The content of P may be $0.1\% \leq P \leq 8\%$. If the content of P is less than 0.1% by mass, the melting point of the brazing material 32 becomes unstable. If the content of P is 8% by mass or more, although the melting point of the brazing material 32 is stable, the wettability between the abrasive grains 31 and the brazing material 32 becomes excessively large, and the abrasive grains 31 are covered with the brazing material 32, so that the grinding function deteriorates.

Next, one embodiment of a method of producing the beveling grindstone 1 will be described. First, the brazing material 32 is temporarily secured to the outer circumferential surface of the core 2, and the abrasive grains 31 are temporarily secured thereto with, for example, an adhesive. The temporarily secured brazing material 32 may be a foil of the brazing material 32 or powder of the brazing material 32. When the brazing material 32 is a foil, it is temporarily secured by spot-welding. When the brazing material 32 is powder, a mixture of the brazing material powder and, for example, a cellulose-based binder is applied to the core 2. Preferably, the abrasive grains 31 are arranged uniformly in a single layer on the groove-ridge portion 23. After the abrasive grains 31 and the brazing material 32 are temporarily secured to the core 2, the core 2 is evacuated to a pressure of about $10^{-3}$ Pa. Then the core 2 is heated to the temperature for melting the brazing material 32 to melt the brazing material 32, whereby the abrasive grains 31 are secured to the core 2. The temperature for melting the brazing material 32 may be equal to or higher than the melting point of the brazing material 32 and at most within +30° C. of the liquidus-line temperature. By limiting the temperature for melting to be low as described above, the core 2 is prevented from being deformed largely by heat.

Next, beveling operation on a hard and brittle material using the above-formed beveling grindstone 1 will be described. The hard and brittle material may be, for example, a silicon wafer, a compound semiconductor wafer, a glass substrate for a flat panel display, or a glass substrate for a hard disk.

Figure 4:
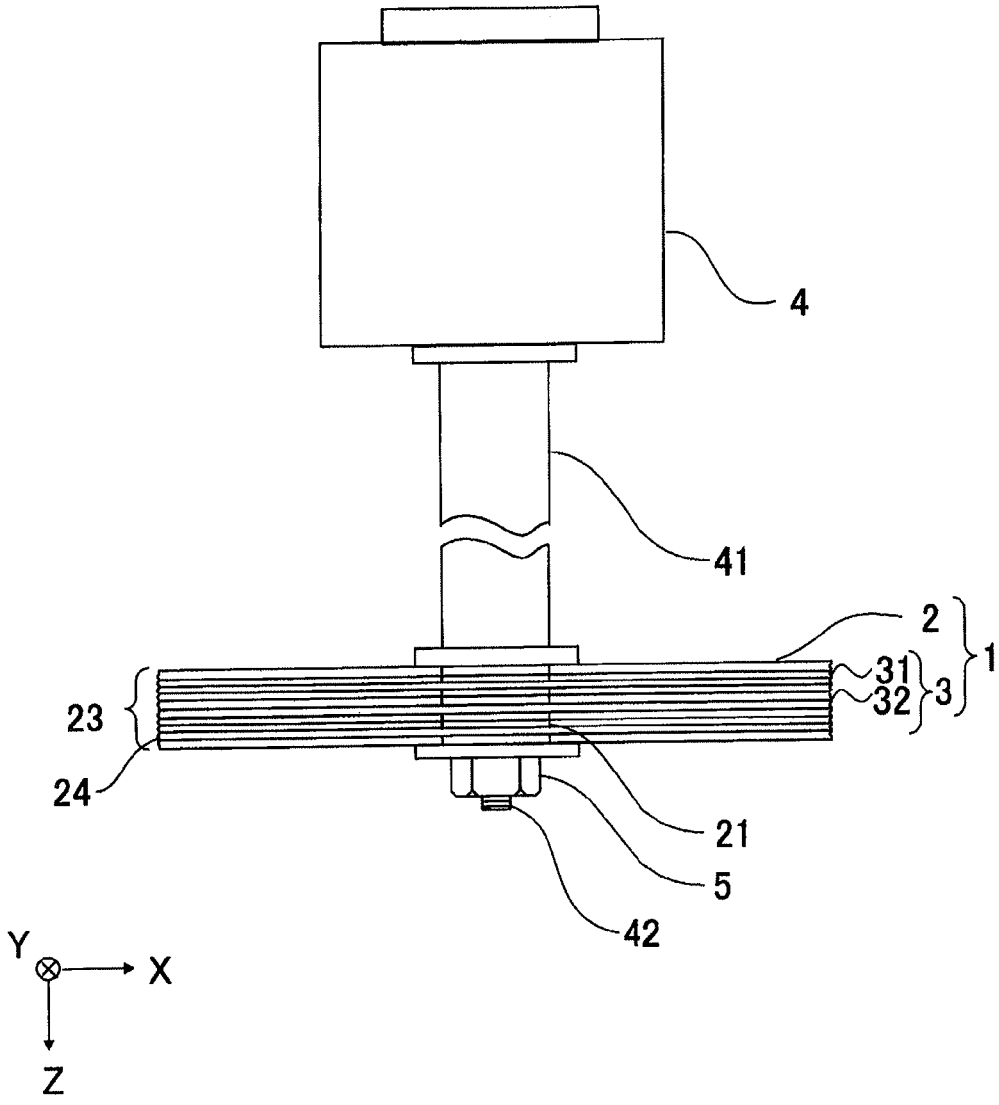
FIG. 4 is a schematic diagram of the beveling grindstone of the present invention when it is attached to an electric motor.

As shown in FIG. 4, the beveling grindstone 1 is secured to a threaded portion 42 formed at the lower end of the rotation shaft 41 of the electric motor 4 by tightening a nut 5 on the threaded portion 42. The hard and brittle material used as a ground object is secured to a work holder (not shown), and the level of the work holder is adjusted such that the beveling grindstone 1 and the work holder are at the same level. After completion of these settings, the electric motor 4 is driven to rotate the beveling grindstone 1 at high speed through the rotation shaft 41. The beveling grindstone 1 rotating at high speed is pressed against the outer circumferential surface of the hard and brittle material at a predetermined pressing force by a beveling grindstone-moving mechanism (not shown) to bevel the hard and brittle material. After completion of the beveling operation, the beveling grindstone-moving mechanism is driven to space the beveling grindstone 1 apart from the hard and brittle material. When the beveling grindstone 1 returns to the initial position, the electric motor 4 and the beveling grindstone-moving mechanism are stopped driving.

The ground object ground by the beveling grindstone 1 of the present invention may be, for example, a silicon wafer or a hard disk substrate. In such a case, the silicon wafer or the hard disk substrate is beveled using a mechanical polishing method that uses pure water as a polishing solution or a CMP (Chemical-Mech. Polishing) method. More specifically, in the CMP method, when the beveling grindstone 1 is brought into contact with the silicon wafer or the hard disk substrate to grind it, a slurry solution containing abrasive particles dispersed in a liquid is supplied to the ground surface of the silicon wafer or the hard disk substrate. By supplying the slurry solution to the ground surface, the beveling processing can be performed with the slurry solution interposed between the beveling grindstone 1 and the silicon wafer or the hard disk substrate. With the above-described method, the synergetic effect of the mechanical polishing action of the abrasive particles and the chemical polishing action of the slurry solution can improve polishing efficiency. Since the pH concentration of the slurry solution can be controlled, the polishing efficiency can be easily controlled. The abrasive particles used in the slurry solution may be silica powder with a particle size of about 10 nm. The liquid used in the slurry solution may be an aqueous solution of a material composed of an alkali metal and a hydroxyl group (OH) such as potassium hydroxide (KOH) or sodium hydroxide (NaOH).

The present invention will be specifically described by way of Examples.

Example 1

In this Example, a grinding test was performed using beveling grindstones 1 including abrasive grains 31 with different average grain diameters ranging from #230 to #5000. More specifically, the average grain diameters of the abrasive grains 31 in Inventive Examples 1 to 6 were #270, #400, #800, #1500, #3000, and #4000, respectively, and the average grain diameters of the abrasive grains 31 in Comparative Examples 1 and 2 were #230 and #5000, respectively. The rotation speed of the beveling grindstones 1 was set to 2,000 m/minute. Silicon wafers having an outer diameter of 200 mm and a thickness of 0.8 mm were used as ground objects. The rotation speed of the silicon wafers was set to 1 rpm. Pure water was used as a processing liquid. Each of the beveling grindstones 1 in Inventive Examples 1 to 6 and Comparative Examples 1 and 2 was brought into contact with a silicon wafer while rotated under the above conditions. When the amount of grinding reached 0.4 mm, the grinding operation was stopped, and the silicon wafer was replaced with a new silicon wafer. The above grinding operation was repeated until the beveling grindstone 1 was no longer usable, and the grinding ability of the beveling grindstone 1 was evaluated according to the total number of processed wafers when the beveling grindstone 1 became no longer usable. The phrase "the beveling grindstone 1 is no longer usable" means a state in which the abrasive grains 31 have fallen off the brazing material 32. The degree of chipping during grinding was also evaluated. The grinding ability was rated as "double circle (excellent)" when the number of processed wafers was 4,000 or more, as "circle (good)" when the number of processed wafers was 1,000 to 4,000, and as "cross (poor)" when the number of processed wafers was 1,000 or less. The degree of chipping was evaluated, and one of three ratings, "large," "medium," and "small," was assigned. The overall evaluation was made as follows. When the grinding ability was rated as "cross" or the degree of chipping was "large," a poor rating denoted by a cross was assigned. When the grinding ability was rated as "circle" and the degree of chipping was "small" or "medium," a fairly good rating denoted by a circle was assigned. When the grinding ability was rated as "double circle" and the degree of chipping was "small" or "medium," an excellent rating denoted by a double circle was assigned. These evaluation results are shown in TABLE 1 below.

TABLE 1

| | AVERAGE GRAIN DIAMETER OF DIAMOND (MESH) | NUMBER OF PROCESSED WAFER | GRINDING ABILITY | DEGREE OF CHIPPING | EXAMINATION RESULTS |
|---|---|---|---|---|---|
| Comparative Example 1 | #230 | 7000 | ◎ | LARGE | X |
| Inventive Example 1 | #270 | 7500 | ◎ | MEDIUM | ◎ |
| Inventive Example 2 | #400 | 7200 | ◎ | SMALL | ◎ |
| Inventive Example 3 | #800 | 8000 | ◎ | SMALL | ◎ |
| Inventive Example 4 | #1500 | 8300 | ◎ | SMALL | ◎ |
| Inventive Example 5 | #3000 | 6000 | ◎ | SMALL | ◎ |
| Inventive Example 6 | #4000 | 3000 | ○ | SMALL | ○ |
| Comparative Example 2 | #5000 | 700 | X | SMALL | X |

Referring to TABLE 1, in Inventive Example 1, the grinding ability was rated as "double circle," and the degree of chipping was "medium," so that the overall evaluation was rated as "double circle." In Inventive Examples 2 to 5, the grinding ability was rated as "double circle," and the degree of chipping was "small," so that the overall evaluation was rated as "double circle." In Inventive Example 6, the grinding ability was rated as "circle," and the degree of chipping was "small," so that the overall evaluation was rated as "circle." In Comparative Example 1, the grinding ability was rated as "double circle," and the degree of chipping was "large," so that the overall evaluation was rated as "cross." In Comparative Example 2, the grinding ability was rated as "cross," and the degree of chipping was "small," so that the overall evaluation was rated as "cross." As can be seen from these evaluation results, when the abrasive grains 31 in the beveling grindstone 1 are finer than #3000, the amount of protrusion of the abrasive grains 31 becomes small, and the grinding ability decreases, so that the number of processed wafers decreases. When the abrasive grains 31 in the beveling grindstone 1 are finer than #4000, the distance between the brazing material 32 and the silicon wafer becomes small, and erosion of the brazing material 32 is facilitated, causing the abrasive grains 31 to fall off. Therefore, the grinding performance of the beveling grindstone 1 is significantly reduced, and the number of processed silicon wafers is significantly reduced. Regarding the chipping, when the abrasive grains 31 in the beveling grindstone 1 are coarser than #270, a silicon wafer is excessively ground, and chipping occurs frequently.

Example 2

In this Example, the securing strength obtained by brazing used in the securing method for securing abrasive grains 31 to the core 2 was evaluated. More specifically, for each of Inventive Example 7 and Comparative Examples 3 and 4 described below, the number of processed sheets of a hard and brittle material and the presence or absence of distortion of the edge shape of the ground surface of the hard and brittle material were evaluated. The beveling grindstone 1 used in Inventive Example 7 was formed by securing diamond abrasive grains having a grain diameter of #1500 to the core 2 by brazing. The beveling grindstone 1 used in Comparative Example 3 was formed by securing abrasive grains 31 having the same grain diameter as that in Inventive Example 7 to the core 2 by an nickel electrodeposition method. The beveling grindstone 1 used in Comparative Example 4 was formed by securing abrasive grains 31 having the same grain diameter as that in Inventive Example 7 to the core 2 by metal bonding (a sintering method). The rotation speed of the beveling grindstones 1 was set to 1,500 m/minute. Glass-made hard disk substrates having an outer diameter of 105 mm and a thickness of 0.5 mm were used as ground objects. The rotation speed of the hard disk substrates was set to 1 rpm. A cerium oxide slurry was used as a processing solution. Each of the beveling grindstones 1 in Inventive Example 7 and Comparative Examples 3 and 4 was brought into contact with a hard disk substrate while rotated under the above conditions. When the amount of grinding reached 0.4 mm, the grinding operation was stopped, and the hard disk substrate was replaced with a new hard disk substrate. The above grinding operation was repeated until the beveling grindstone 1 was no longer usable, and the grinding ability of the beveling grindstone 1 was evaluated according to the total number of processed substrates when the beveling grindstone 1 became no longer usable. The phrase "the beveling grindstone 1 is no longer usable" means a state in which the abrasive grains 31 have fallen off the brazing material 32. These evaluation results are shown in TABLE 2 below.

TABLE 2

| | METHOD FOR JOINING DIAMOND | NUMBER OF PROCESSED SUBSTRATES | SHAPE OF END FACE |
|---|---|---|---|
| INVENTIVE EXAMPLE 7 | BRAZING | 17000 | ALMOST NO DISTORTION |
| COMPARATIVE EXAMPLE 3 | NICKEL ELECTRODEPOSITION | 800 | LARGE DISTORTION |
| COMPARATIVE EXAMPLE 4 | METAL BONDING (SINTERING) | 1500 | LARGE DISTORTION |

As shown in TABLE 2, it was found that, in Inventive Example 7, the number of processed substrates was 17,000 and the life was long. In addition, no shape distortion was found on the end faces, i.e., the ground surfaces, of the hard disk substrates. However, in Comparative Examples 3 and 4, since the strength for securing the abrasive grains 31 was insufficient, abrasive grains 31 fell off the core 2 at an early stage, and the grinding ability of the beveling grindstones 1 deteriorated. Therefore, the numbers of processed hard disk substrates were smaller than, i.e., 1/10 to 1/20, that in Inventive Example 7, and the life was found to be shorter. In Comparative Examples 3 and 4, it was also found that, since abrasive grains 31 fell off the core 2 at an early stage, portions with no abrasive grains 31 were formed in the beveling grindstones 1, so that the edge shape of the ground surface of the hard and brittle material was distorted.

The present invention can be embodied in various forms without departing from the spirit or main features of the invention. Therefore, the above-described embodiments are merely examples in all respects and must not be construed to limit the invention. The scope of the present invention is defined by the scope of the appended claims and is not limited at all by the description of this specification. In addition, any modifications, changes, substitutions, and alterations belonging to equivalents of the claims fall within the scope of the present invention.

The invention claimed is:

1. A beveling grindstone for beveling an outer circumferential edge of a hard and brittle material, comprising:

a core having a groove portion formed on an outer circumferential surface thereof with which the outer circumferential edge of the hard and brittle material is brought into contact; and an abrasive grain layer which is formed in the groove portion and to which abrasive grains are secured by brazing, wherein an average grain diameter of the abrasive grains is #3000 to #400, wherein a thickness of the brazing at a first position spaced apart from the abrasive grains is smaller than a thickness of the brazing at a second position in the vicinity of the abrasive grains.

2. The beveling grindstone according to claim 1, wherein the abrasive grains are diamond.

3. The beveling grindstone according to claim 1, wherein the core is made of stainless steel.

4. The beveling grindstone according to claim 2, wherein the core is made of stainless steel.

* * * * *